US007193724B2

(12) United States Patent
Isei et al.

(10) Patent No.: US 7,193,724 B2
(45) Date of Patent: Mar. 20, 2007

(54) METHOD FOR MEASURING THICKNESS OF THIN FILM-LIKE MATERIAL DURING SURFACE POLISHING, AND SURFACE POLISHING METHOD AND SURFACE POLISHING APPARATUS

(75) Inventors: Yoshito Isei, Osaka (JP); Tokumi Hirai, Tokyo (JP)

(73) Assignee: Sumitomo Mitsubishi Silicon Corporation, Tokyo (JP)

( * ) Notice: Subject to any disclaimer, the term of this patent is extended or adjusted under 35 U.S.C. 154(b) by 389 days.

(21) Appl. No.: 10/872,524

(22) Filed: Jun. 22, 2004

(65) Prior Publication Data

US 2004/0263868 A1 Dec. 30, 2004

(30) Foreign Application Priority Data

Jun. 30, 2003 (JP) ..... 2003-186245

(51) Int. Cl.
*G01B 9/02* (2006.01)

(52) U.S. Cl. ..... 356/503

(58) Field of Classification Search ..... 356/503, 356/504; 438/14, 16

See application file for complete search history.

(56) References Cited

U.S. PATENT DOCUMENTS 5,838,448 A * 11/1998 Aiyer et al. ..... 356/632

6,645,045 B2 * 11/2003 Ohkawa ..... 451/6

FOREIGN PATENT DOCUMENTS

| | | |
|---|---|---|
| JP | 07-004921 | 1/1995 |
| JP | 09-036072 | 2/1997 |
| JP | 09-092870 | 4/1997 |
| JP | 2001-284301 | 10/2001 |

* cited by examiner

*Primary Examiner*—Hwa (Andrew) Lee
(74) *Attorney, Agent, or Firm*—Bacon & Thomas, PLLC

(57) ABSTRACT

A thickness of a wafer during polishing operation is detected to accurately perform the polishing. A thickness measuring method, which measures the thickness of the wafer of wafer 7 in polishing a surface, comprises the steps of irradiating the thin film-like material during the surface polishing from a backside with probe light, measuring a reflectance spectrum with a dispersion type multi-channel spectroscope using a photodiode array which has particularly high sensitivity to light having a wavelength ranging from 1 to 2.4 μm, and calculating the thickness on the basis of a wave form of the reflectance spectrum. The surface polishing is performed while the thickness of the wafer 7 is measured by the above-described thickness measuring method, and the polishing is finished when the thickness of the wafer 7 reaches a target thickness.

7 Claims, 9 Drawing Sheets

METHOD FOR MEASURING THICKNESS OF THIN FILM-LIKE MATERIAL DURING SURFACE POLISHING, AND SURFACE POLISHING METHOD AND SURFACE POLISHING APPARATUS

CROSS-REFERENCE TO RELATED APPLICATION

This application claims, under 35 USC 119, priority of Japanese Application No. 2003-186245 filed Jun. 30, 2003.

BACKGROUND OF THE INVENTION

The present invention relates to a thickness measuring method used in polishing a surface of a thin film-like material such as a semiconductor wafer, and a surface polishing method and a surface polishing apparatus. Specifically, the invention relates to the method of measuring a thickness of the thin film-like material during the surface polishing, which measures and controls the thickness of the thin film-like material while performing the polishing process in polishing the thin film-like material such as an active layer surface of SOI (Silicon On Insulator) or a silicon wafer surface, and a surface polishing method and a surface polishing apparatus.

After a slicing process, the silicon wafer is mirror-polished in the polishing process through a rapping process and an etching process. The thickness of the silicon wafer and a film thickness of SOI are controlled by a CMP (Chemical Mechanical Polishing or Chemical Mechanical Planarization) method. In a substrate polishing apparatus used in the CMP method, while a substrate (semiconductor wafer) attached to a substrate holder is pressed against a polishing pad fixed to a polishing surface plate, relative movement is given to the substrate and the polishing pad, and the substrate surface is globally polished by chemical polishing action and mechanical polishing action of an abrasive material (slurry) supplied from an abrasive material supply mechanism.

Recently, demand for flatness and parallelism of the silicon wafer becomes more severe. In order to improve the flatness and the parallelism of the silicon wafer, it is necessary to accurately control the thickness of the silicon wafer. In the case where an SOI structure is formed by bonding two wafers and polishing is performed in order to obtain the active layer having a predetermined thickness, it is important to control the thickness of SOI. Particularly, it is desired that the thickness is measured in situ to control the thickness during the polishing. Accuracy of the thickness measurement largely affects a semiconductor device manufactured by the apparatus, which in turn affects quality of an integrated circuit.

Recently, the SOI structure wafer is widely utilized as a base material for a micromachine or a microsensor which is produced by microfabrication utilizing the semiconductor manufacturing process. At this point, the thickness of the SOI structure active layer largely affects the accuracy of dimension of the microfabrication, which in turn affects the assembled micromachine and performance of the microsensor.

However, all the conventional substrate polishing apparatuses are extensions of the existing apparatus, and currently the conventional substrate polishing apparatus does not sufficiently satisfy the upgrading demand for the accuracy of finishing. Particularly the conventional management method performed by setting a machining time can not sufficiently deal with variations in remaining film thickness between lots. Namely, a variable factor of polishing quantity per unit time (polishing rate) includes various factors fluctuating from time to time, such as clogging of the polishing pad, polishing machining pressure, supply quantity of the abrasive material, environmental temperature near the substrate. However, the conventional management method performed by setting the machining time can not sufficiently deal with the variable factor of the polishing quantity per unit time.

The method in which the remaining film thickness after the polishing is measured with a dedicated apparatus such as an optical film thickness meter and feedback of the measurement result is performed to control the remaining film thickness is also adopted. However, in this method, the following drawback can be cited, in addition to a drawback that temporal stop of the polishing operation is required for the measurement. Even if the correct remaining film thickness of the substrate which has been already polished is obtained to a certain extent by the measurement, it is still difficult to accurately obtain the remaining film thickness of a final target due to the above-described variable factors. Since the method can not still solve the difficulty of obtaining accurately the remaining film thickness of the final target, a process finish point can not be accurately detected. Therefore, the variations in remaining film thickness between lots can not be neglected.

Currently development on the detection of the finish point by an optical method is rapidly pursued. A potential example of the optical finish point detection technology will be shown below. In the technology, while the substrate (Si wafer or SOI wafer) attached to the substrate holder is pressed against the polishing pad fixed to the polishing surface plate, relative movement is given by the rotational movement of the substrate and the rotational movement of the polishing pad, and the substrate is irradiated with probe light to detect the polishing process finish point when the substrate surface is globally polished by the chemical polishing action and the mechanical polishing action of the abrasive material (slurry) supplied from the abrasive material supply mechanism. Specifically, the semiconductor wafer (Si wafer or SOI wafer) is irradiated with the probe light emitted from a light source through openings which are made in the polishing pad and the polishing surface plate or the substrate holder, reflected light from the semiconductor wafer is guided to a spectroscope, and the thickness measurement of the Si wafer or SOI is performed by an interference waveform included in a spectrum to detect the polishing process finish point.

However, in the finish point detection methods which have been proposed, the discloser is limited to only a scope of principle, and an arrangement of constituents such as the specific optical system has not been clearly disclosed.

The invention described in Japanese Patent Application Laid-Open (JP-A) No. 9-36072 has proposed the method which performs the measurement by making holes in the polishing pad and the polishing surface plate, and the invention described in JP-A No. 2001-284301 has proposed the method which performs the measurement by making the hole in the substrate holder.

Although the method which performs the measurement by making holes in the polishing pad and the polishing surface plate is described in JP-A NO. 9-36072, there is no description concerning a configuration of an optical sensor. In this method, it is necessary that a monitor device is fixed to the rotating polishing surface plate, and the monitor device includes the light source and a photodetector, so that a considerable storage space for storing the monitor device is required in a lower portion of the polishing surface plate. Consequently, there is a large constraint in design of the CMP polishing apparatus. Generally such an apparatus as the CMP polishing apparatus used in an expensive clean room is particularly strongly required to miniaturize the apparatus and save weight of the apparatus. Therefore, the large storage space not only decreases a degree of freedom of the design but also becomes large obstacles of the miniaturization and the weight saving of the CMP polishing apparatus.

Although the method which performs the measurement by making the hole in the substrate holder is described in JP-A No. 2001-284301, there is also no description concerning the specific optical sensor. In order to realize the method described in JP-A No. 2001-284301, the specific descriptions such as specifications of the used spectroscope and the method of selecting an optical fiber in conducting the rotating wafer probe light are required. However, there is no specific description.

Although one end of the optical fiber is held by an optical rotating coupler device and the other end is held while the other end is close to the wafer, the specific structure is not described. A wafer holder rotatably supporting the wafer is provided on the other end side of the optical fiber, and the other end of the optical fiber is configured to be held while being close to the wafer, so that it is speculated that the other end of the optical fiber is held by the wafer holder. In this case, there is no trouble in the surface polishing operation of the wafers having the same diameter. However, the surface polishing operation of the wafers having the different diameters causes trouble with replacement operation of the wafer holder. Specifically the other end of the optical fiber is detached from the wafer holder to replace the wafer holder, and then the other end of the optical fiber is held at a correct position again. Therefore, the replacement operation is not easy.

SUMMARY OF THE INVENTION

In view of the foregoing, it is an object of the invention to provide a thickness measuring method which can optically perform the measurement of the remaining film thickness of the thin film-like material such as the semiconductor wafer during surface polishing and the detection of the process finish point with high accuracy.

It is another object of the invention to provide the surface polishing method and the surface polishing apparatus which can polish the thin film-like material with high accuracy by adopting the thickness measuring method.

In order to solve the above-described problems, a thickness measuring method according to a first invention which measures a thickness of a thin film-like material during surface polishing, comprises the steps of irradiating the thin film-like material during the surface polishing from a backside with probe light, measuring a reflectance spectrum with a dispersion type multi-channel spectroscope using a photodiode array which has particularly high sensitivity to light having a wavelength ranging from 1 to 2.1 μm, and calculating the thickness on the basis of a waveform of the reflectance spectrum.

According to the above configuration, the light having the wavelength ranging from 1 to 2.1 μm is used as the measuring wavelength. Therefore, the probe light which has the excellent transmission to water used in the polishing, the excellent transmission to Si, and the excellent transmission to the optical fiber can be obtained. The thin film-like material is irradiated from the backside to measure the spectrum of the reflected light with the dispersion type multi-channel spectroscope. Therefore, the thickness of the thin film-like material can be stably and accurately detected during the polishing operation.

An InGaAs array is used as the photodiode array. The reflected light having the wavelength ranging from 1 to 2.4 μm can be detected with high sensitivity with the InGaAs array to accurately detect the thickness.

A fluorescent coating which emits visible light when the light having a wavelength ranging from 1 to 2.4 μm is incident is applied onto a surface of the photodiode array. The reflected light reflected by irradiating the thin film-like material with the probe light having the wavelength ranging from 1 to 2.4 μm can be converted into the visible light by the fluorescent coating and securely detected with the photodiode array.

A period of an interference waveform (wave number interval) Δk included in the obtained spectrum is measured and the thickness of the thin film-like material during the surface polishing is calculated by the following equation.

$$\begin{aligned} t &= 1/(2n)\times[(1/\lambda_{m+1})-(1/\lambda_m)]^{-1} \\ &= 1/(2n)\times(k_{m+1}-k_m)^{-1} \\ &= 1/(2n\Delta k) \end{aligned}$$

t: thickness
n: reflective index of Si
λ: wavelength of probe light
m: integer

Therefore, the thickness of the thin film-like material can be accurately detected.

In this case, the period of the interference waveform Δk is measured from frequency estimation by an autoregressive model. The thickness of the thin film-like material which has the thickness not lower than 4 μm, particularly not lower than 5 μm can be accurately measured by the use of the frequency estimation by the autoregressive model.

A surface polishing method according to a second invention is characterized in that the surface polishing is performed while the thickness of thin film-like material is measured by the above-described thickness measuring method, and the polishing is finished when the thickness of thin film-like material reaches a target thickness. Therefore, during the surface polishing of the thin film-like material such as the wafer, the thickness of the thin film-like material can be measured without stopping the polishing operation, the surface polishing can be performed on the basis of the measurement result, and the polishing can be accurately performed until the thickness of the thin film-like material reaches the target thickness.

In this case, before the polishing, it is preferable that the thicknesses of a plurality of points in the surface of the thin film-like material are measured in addition to a central thickness of the thin film-like material and the polishing target thickness is determined from the following equation.

$$t_{cfin}=t_{aim}+t_c-(t_{max}+t_{min})/2$$

$t_{cfin}$: polishing target thickness
$t_{aim}$: required film thickness
$t_c$: central thickness of thin film-like material
$t_{max}$: maximum thickness in in-plane measurement points
$t_{min}$: minimum thickness in in-plane measurement points Therefore, the surface polishing of the thin film-like material can be accurately performed to the polishing target film thickness.

Otherwise, before the polishing, it is preferable that the thicknesses of the plurality of points in the surface of the thin film-like material are measured in addition to the central thickness of the thin film-like material and the polishing target thickness is determined from the following equation.

$$t_{cfin}=t_{aim}+t_c-t_{ave}$$

$t_{cfin}$: polishing target thickness $t_{aim}$: required film thickness $t_c$: central thickness of thin film-like material $t_{ave}$: average thickness in in-plane measurement points Therefore, the surface polishing of the thin film-like material can be accurately performed to the polishing target film thickness.

A surface polishing apparatus according to a third invention which includes a holder unit holding a thin film-like material to be polished and a main body unit driving rotation of the holder unit while rotatably supporting the holder unit, the surface polishing apparatus comprises a communication hole which is provided from the main body unit through a rotational center of the holder unit, an optical fiber which is passed through the communication hole, a front end surface of the optical fiber being provided to face a backside of the thin film-like material during the surface polishing held by the holder unit, the thin film-like material during the surface polishing being irradiated with probe light for thickness measurement, light reflected from the thin film-like material being incident to the optical fiber, and an optical fiber holder member which is provided at a front end portion of the communication hole on a side of the holder unit to support an front end of the optical fiber, the optical fiber holder member including a support hole which positions the front end of the optical fiber to rotatably and detachably support the front end of the optical fiber, and the support hole including a small hole portion having an inner diameter slightly larger than a diameter of the optical fiber and a taper-shaped guide portion which is continuously formed from the small hole portion to guide the front end of the optical fiber along a inclined surface to the small hole portion.

According to the above-described configuration, in the case where the optical fiber is attached to the communication hole, the optical fiber is passed through the communication hole, and the front end of the optical fiber is inserted into the support hole of the optical fiber holder member at the front end portion of the communication hole. At this point, the front end of the optical fiber is guided along the inclined surface of the guide portion to the small hole portion and inserted into the small hole portion to be supported. Therefore, the optical fiber can be easily inserted and pulled out.

It is preferable that the front end surface of the optical fiber is provided to face the backside of the thin film-like material in the surface polishing while the optical fiber is continuously provided from the front end portion of the communication hole to the external instrument through the base end opening. Therefore, while the backside of the thin film-like material during the surface polishing is irradiated with the probe light from the front end surface of the optical fiber, the reflected light penetrates into the optical fiber and is transmitted to the external instrument. As a result, the irradiation of the probe light can be accurately performed and the reflected light can be securely detected. Since the front end of the optical fiber is not fixed to but rotatably inserted into the optical fiber holder member, while the thickness of the thin film-like material can be accurately measured during the surface polishing without affecting the influence of the holder unit which holds and rotates the thin film-like material, the thin film-like material can be accurately polished to the target thickness.

It is preferable that the optical fiber includes a fiber-in-hole portion which is passed through the communication hole and an external fiber portion which is drawn outside to connect to the external instrument, the fiber-in-hole portion is rotatably supported in the communication hole, and the external fiber portion is connected to the fiber-in-hole portion by the optical fiber rotary joint. Therefore, by inserting the fiber-in-hole portion into the communication hole, while the base end portion of the fiber-in-hole portion is rotatably supported in the communication hole, the front end portion of the fiber-in-hole portion is rotatably supported in the support hole of the optical fiber holder member. Further, the fiber-in-hole portion and the external fiber portion are connected to each other by the optical fiber rotary joint while absorbing the rotation. Therefore, while the thickness of the thin film-like material can be accurately measured during the surface polishing without affecting the influence of the holder unit which holds and rotates the thin film-like material, the thin film-like material can be accurately polished to the target thickness.

It is preferable that a single core optical fiber is used as the fiber-in-hole portion, and a bundle type fiber in which some of the plurality of optical fibers are connected to the spectroscope and the remaining optical fibers are connected to an infrared white light source is used as the external fiber portion, and an effective core diameter of the bundle type fiber is smaller than the core diameter of the single core optical fiber. Therefore, the probe light is transmitted from the plurality of optical fibers connected to the infrared white light source in the external fiber portion to the single core optical fiber of the fiber-in-hole portion, and the backside of the thin film-like material is irradiated with the probe light from the front end surface of the fiber-in-hole portion. The reflected light from the backside of the thin film-like material propagates from the front end surface of the fiber-in-hole portion through a part of optical fibers of the external fiber portion, and the reflected light is incident to the spectroscope. Therefore, the backside of the thin film-like material can be securely irradiated with the probe light to securely detect the reflected light.

PREFERRED EMBODIMENTS OF THE INVENTION

The preferred embodiments of the invention will be described referring to the accompanying drawings.

[Surface Polishing Apparatus]

Figure 1:
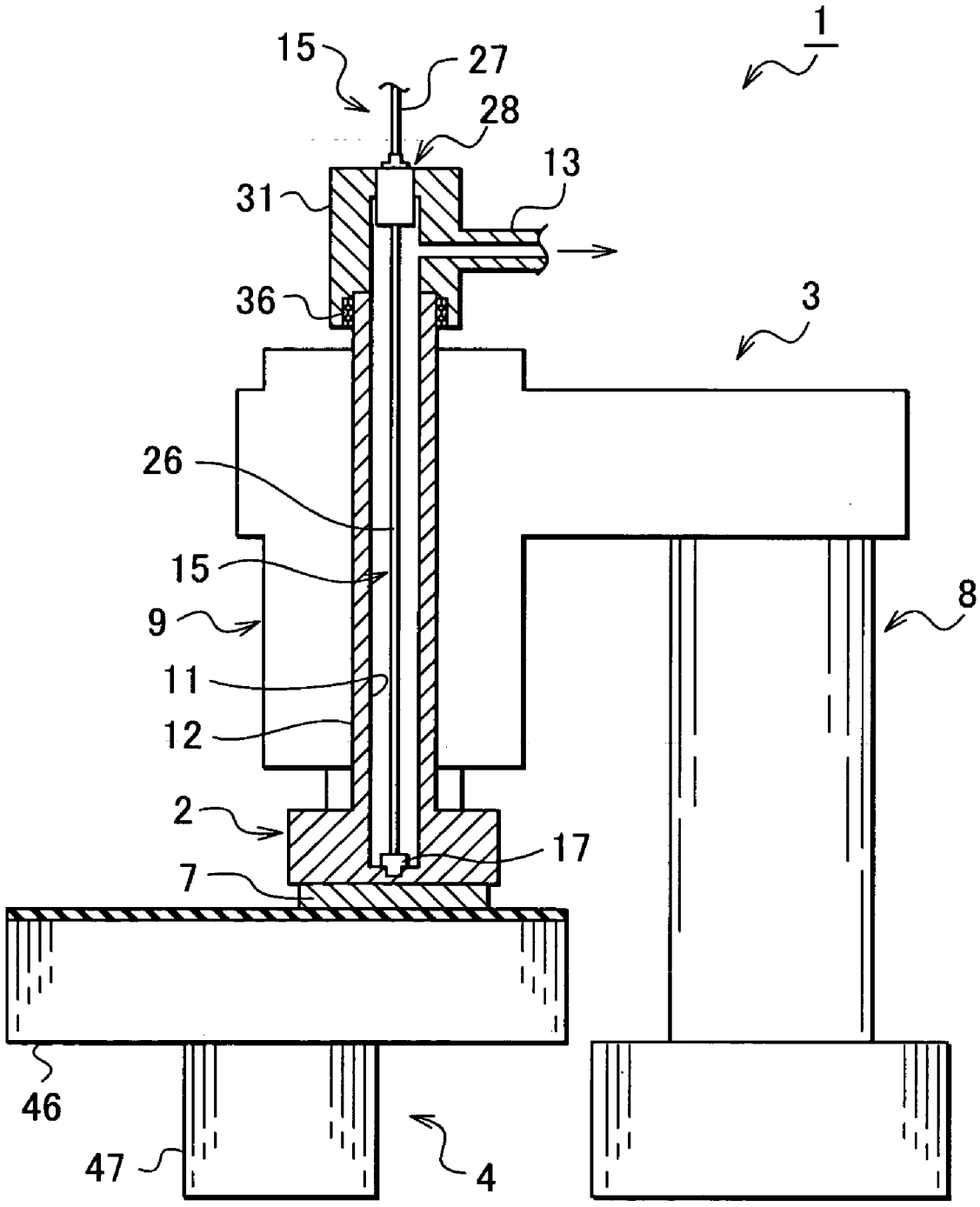
FIG. 1 is a schematic block diagram showing a surface polishing apparatus according to an embodiment of the invention.
Figure 2:
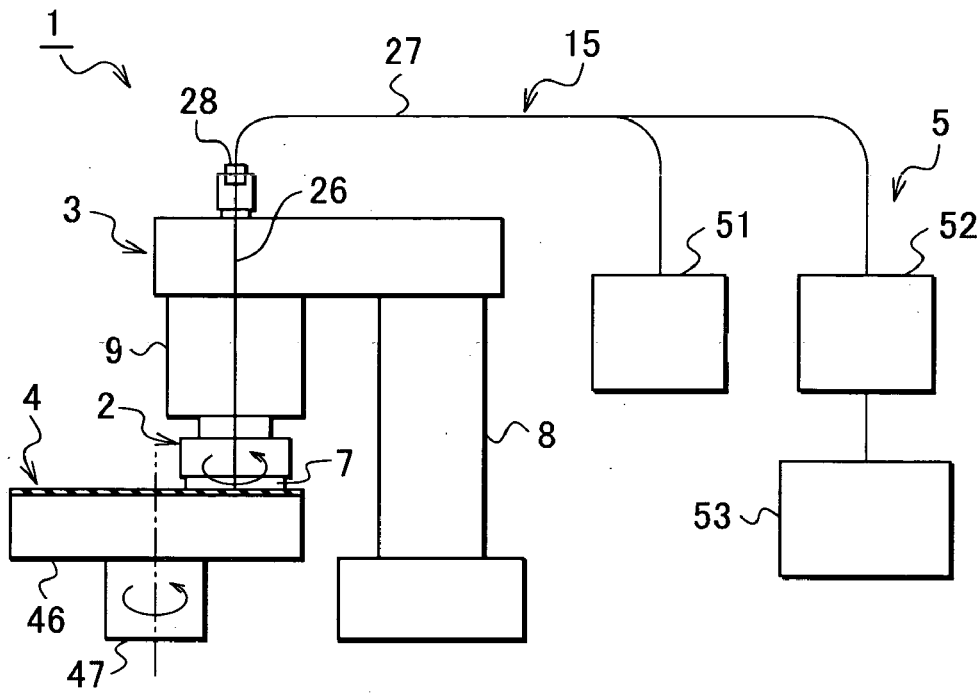
FIG. 2 is a schematic block diagram showing the surface polishing apparatus according to the embodiment of the invention.
Figure 3:
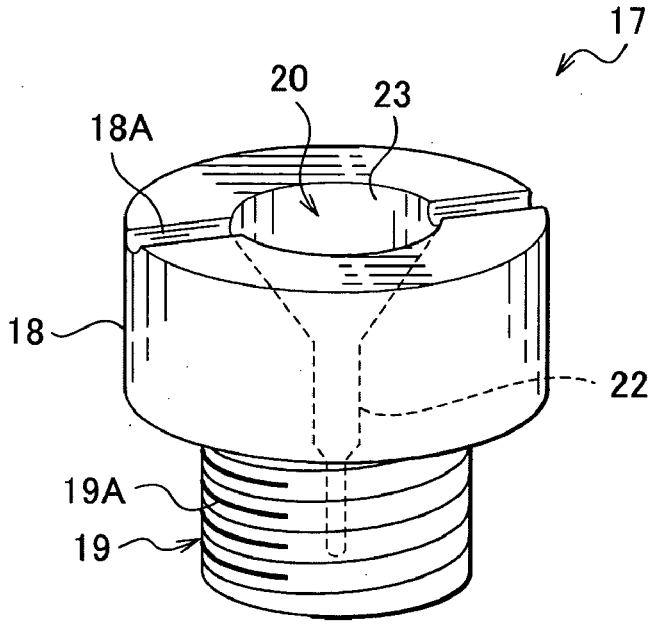
FIG. 3 is a perspective view showing an optical fiber holder member of the surface polishing apparatus according to the embodiment of the invention.
Figure 4:
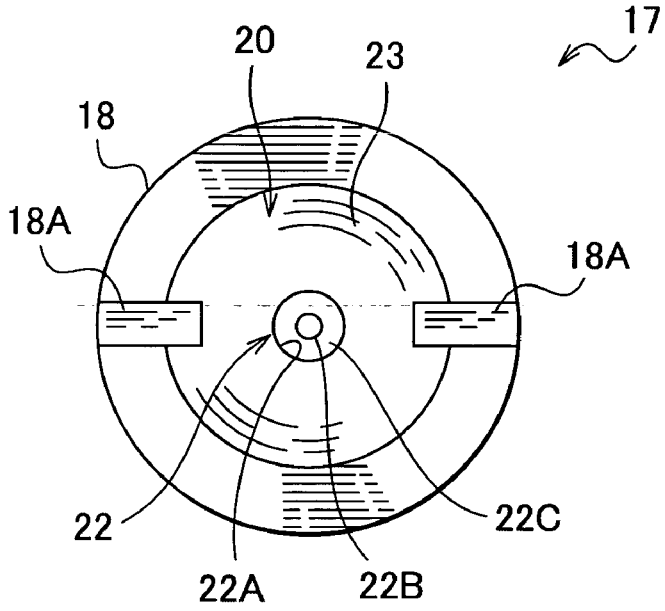
FIG. 4 is a plan view showing the optical fiber holder member.
Figure 5:
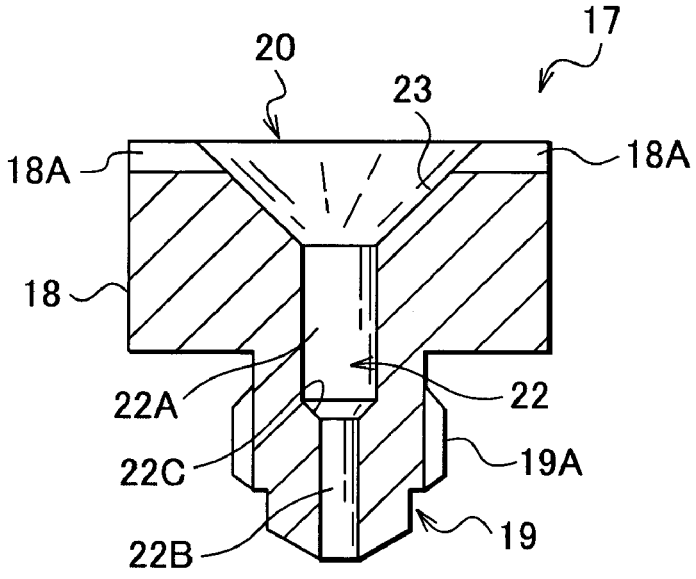
FIG. 5 is a sectional elevation showing the optical fiber holder member.
Figure 6:
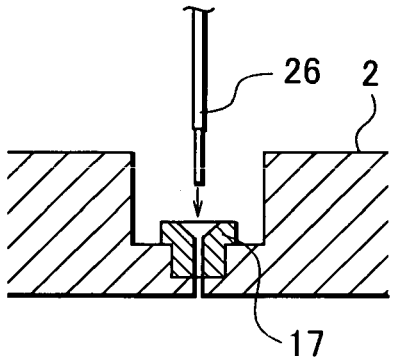
FIG. 6 is a sectional view of a main part showing a state in which the optical fiber holder member is attached to a front end of a holder unit.

As shown in FIGS. 1 and 2, a surface polishing apparatus mainly includes a holder unit 2, a main body unit 3, a polishing surface plate 4, and a control unit 5.

The holder unit 2 holds a wafer 7 which is of the thin film-like material to be polished. The holder unit 2 is rotatably supported downward at a lower end of a rotation support unit 9 of the main body 3 mentioned later. The lower surface of the holder unit 2 is one which sucks the wafer 7. Specifically, a plurality of suction ports (not shown) for evacuation is provided in the lower surface of the holder unit 2.

The main body unit 3 rotatably supports the holder unit 2 and drives rotation of the holder unit 2 at the setting number of revolutions during the polishing. The main body unit 3 includes a base unit 8 and the rotation support unit 9. The base unit 8 is fixed to a floor unit to support the rotation support unit 9. The rotation support unit 9 drives the rotation of the holder unit 2. The rotation support unit 9 is supported by the base unit 8 and supports the holder unit 2 while the holder unit 2 faces the polishing surface plate 4. A driving device (not shown) which drives the rotation of the holder unit 2 is provided in the rotation support unit 9. In this case, the driving device is set so as to rotate the holder unit 2 at 100 rpm.

A suction hole 11 which communicates with the suction ports in the lower surface of the holder unit 2 to perform the evacuation is provided in the rotation support unit 9 of the main body unit 3. The suction hole 11 includes a suction cylinder 12 which is provided in the central portion in the rotation support unit 9 while piercing from the upper surface through the lower surface. The suction cylinder 12 is configured to be integrally connected to the holder unit 2 to rotate with the holder unit 2.

The lower front end of the suction hole 11 is communicated to the plurality of suction ports which are opened toward the lower surface of the holder unit 2. An upper base end portion of the suction hole 11 is formed while project upward from the rotation support unit 9 of the main body unit 3 by the suction cylinder 12, and the upper base end portion of the suction hole 11 is opened upward. The opening of the base end portion is connected to a pipe 13 extending to a vacuum pump.

Further, the suction hole 11 in the rotation support unit 9 of the main body unit 3 is formed as a communication hole for passing through an optical fiber 15. In the optical fiber 15 which is passed through by the suction hole 11 of the communication hole, the front end surface of the optical fiber 15 is provided while facing a backside (the surface on the upper side in the drawing) of the wafer 7 held by the holder unit 2 during the surface polishing.

An optical fiber holder member 17 is provided at the front end portion on the side of the holder unit 2 in the suction hole 11. The optical fiber holder member 17 positions the front end of the optical fiber 15 to rotatably and detachably hold the optical fiber 15.

As shown in FIGS. 3 to 6, the optical fiber holder member 17 includes a cylinder portion 18, a screw portion 19, and a support hole 20. The support hole 20 is provided in the center of the cylinder portion 18. The cylinder portion 18 is formed in the shape of a thick disk, and the support hole 20 is provided on the upper surface of the cylinder portion 18 while opened upward. A groove 18A for a driver is provided in the upper surface of the cylinder portion 18, and the driver fits in the groove 18A in the case where the screw portion 19 is screwed on the side of the holder unit 2.

The screw portion 19 is continuously provided on the under side of the cylinder portion 18, and the screw portion 19 fixes the optical fiber holder member 17 to the holder unit 2. A thread 19A is provided in an outer periphery of the screw portion 19, and the support hole 20 is made through in the central portion.

The support hole 20 directly positions the optical fiber 15 to rotatably and detachably support the optical fiber 15 by inserting the front end of the optical fiber 15. The support hole 20 includes a small hole portion 22 and a guide portion 23.

The small hole portion 22 includes an upper-side small hole portion 22A and a lower-side small hole portion 22B. An inner diameter of the upper-side small hole portion 22A is set larger than the diameter of the optical fiber 15 to some extent, and the front end of the optical fiber 15 is easily inserted into the upper-side small hole portion 22A. A taper 22C is provided at the lower end of the upper-side small hole portion 22A, and the front end of the optical fiber 15 can be smoothly inserted into the lower-side small hole portion 22B. The taper 22C guides the front end of a fiber-in-hole portion 26 from the upper-side small hole portion 22A to the lower-side small hole portion 22B and inserts the optical fiber 15 into the lower-side small hole portion 22*b*.

The inner diameter of the lower-side small hole portion 22B is set slightly larger than the diameter of the optical fiber 15. The front end surface of the optical fiber 15 is accurately positioned by inserting the front end of the optical fiber 15 into the lower-side small hole portion 22B having the smaller diameter, so that the backside of the wafer 7 can be irradiated with probe light to detect the reflected light. Further, the lower-side small hole portion 22B rotatably and detachably supports the optical fiber 15 in such a manner that the inner diameter of the lower-side small hole portion 22B is formed slightly larger than the diameter of the optical fiber 15.

The guide portion 23 guides the front end of the optical fiber 15 to the small hole portion 22. The guide portion 23 is formed to include a taper-shaped inclined-surface which is continuously formed from the upper-side small hole portion 22A of the small hole portion 22, and the guide portion 23 guides the front end of the optical fiber 15 along the inclined surface to the small hole portion 22.

The optical fiber holder member 17 is made of fluorocarbon resin (polytetrafluoro-ethylene) having a small friction coefficient, and the front end of the optical fiber 15 is smoothly inserted into and drawn from the small hole portion 22.

Figure 7:
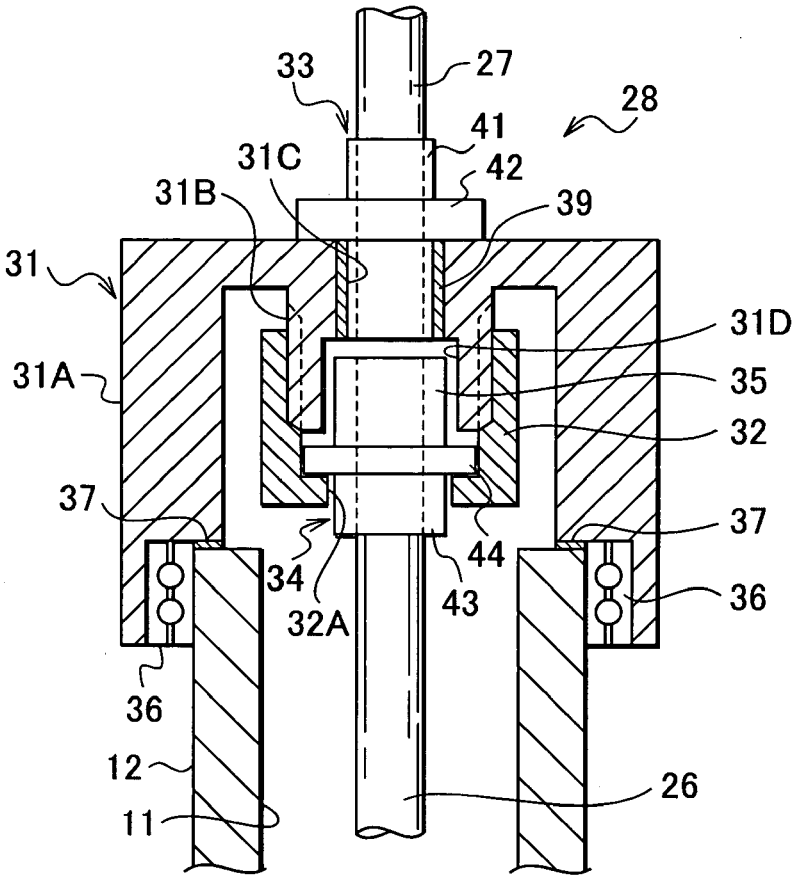
FIG. 7 is a sectional view of a main part showing an optical fiber rotary joint.

As shown in FIGS. 1, 2, and 7, the optical fiber 15 is arranged from the front end portion of the suction hole 11 to the control unit 5 through the base end opening while the front end portion of the optical fiber 15 is positioned to the optical fiber holder member 17. The optical fiber 15 includes the fiber-in-hole portion 26, an external fiber portion 27, and an optical fiber rotary joint 28.

Figure 8:
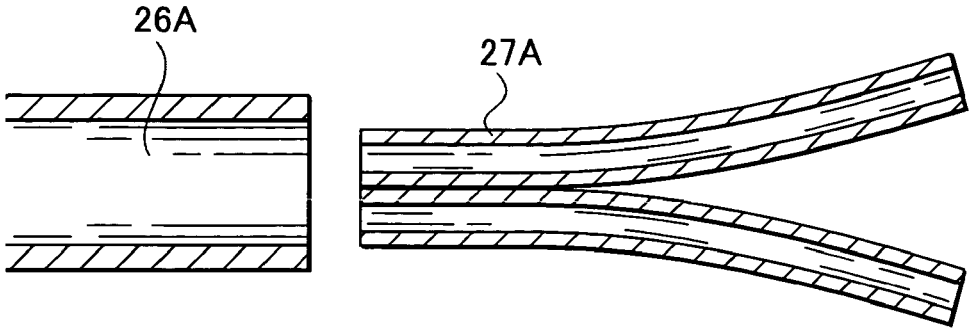
FIG. 8 is a transverse sectional view showing a single core optical fiber and a bundle type optical fiber.

The fiber-in-hole portion 26 is inserted into the suction hole 11 and rotatably supported by the optical fiber rotary joint 28. The fiber-in-hole portion 26 includes a single core optical fiber 26A (see FIG. 8), and the probe light and the reflected light pass through the inside of the single core optical fiber 26A. The reason for using the single core optical fiber is that the transmitted light quantity is not changed during the rotation, since sometimes the fiber-in-hole portion 26 is rotated. A length of the fiber-in-hole portion 26 is set so that the front end surface of the fiber-in-hole portion 26 is inserted into the optical fiber holder member 17 to face the backside of the wafer 7 within a distance of 1 mm, while the fiber-in-hole portion 26 is attached to the suction hole 11. This is because the light spreads out from the front end surface of the fiber-in-hole portion 26 and the detectable light quantity becomes little, when the front end surface of the fiber-in-hole portion 26 is too far away from the backside of the wafer.

Figure 9:
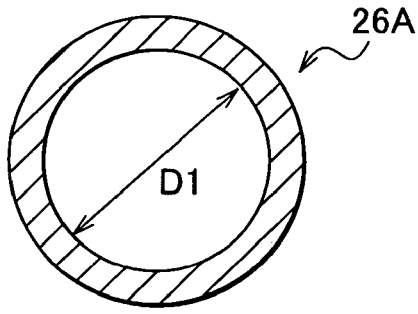
FIG. 9 is a longitudinal sectional view showing the single core optical fiber.
Figure 10:
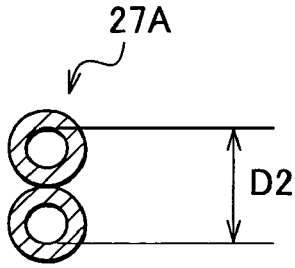
FIG. 10 is a longitudinal sectional view showing the bundle type optical fiber.

The external fiber portion 27 is drawn outside to connect to the control unit 5 while optically connected to the fiber-in-hole portion 26. The external fiber portion 27 includes a bundle type fiber 27A (see FIG. 8) which bundles the plurality of optical fibers. In this case, the two optical fibers are bundled to form the bundle type fiber 27A. Some of the plurality of optical fibers 15 formed by the bundle type optical fibers 27A are connected to a later-mentioned spectroscope 52 in the control unit 5, and the remaining optical fibers are connected to an infrared white light source 51. An effective core diameter D2 (see FIG. 10) of the bundle type fiber 27A is set smaller than a core diameter D1. (see FIG. 9) of the single core optical fiber 26A of the fiber-in-hole portion 26. Therefore, all the probe light beams from the infrared white light source 51 are incident to the single core optical fiber 26A, and the reflected light having the sufficient light quantity is incident to the spectroscope 52 through the bundle type fiber 27A. At this point, in order to sufficiently secure an interference light reflected from the wafer 7, it is preferable that the core diameters D1 and D2 are close to each other.

The optical fiber rotary joint 28 rotatably connects the fiber-in-hole portion 26 and the external fiber portion 27. While the optical fiber rotary joint 28 absorbs the rotations of the external fiber portion 27 and the fiber-in-hole portion 26, the optical fiber rotary joint 28 arranges and connects the external fiber portion 27 and the fiber-in-hole portion 26 so that the distance between the fiber end faces of the external fiber portion 27 and the fiber-in-hole portion 26 becomes 0.1 mm. The optical fiber rotary joint 28 includes an outside cover portion 31, an inside cover portion 32, an outside insertion plug 33, and an inside insertion plug 34.

The outside cover portion 31 inserts and supports the outside insertion plug 33 while closing the base end opening of the suction cylinder 12. The outside cover portion 31 is formed in the double-cylinder shape whose one end is opened downward, and the outside cover portion 31 includes an outside cylinder portion 31A and an inside cylinder portion 31B. The outside cylinder portion 31A is rotatably attached to the suction cylinder 12 with a bearing 36. A sealing material 37 is provided between the outside cylinder portion 31A and the suction cylinder 12. The sealing material 37 seals a position between the outside cylinder portion 31A and the suction cylinder 12 while rotatably supported by the bearing 36.

The inside cylinder portion 31B is provided while piercing from the upper surface through the lower surface. The outside insertion plug 33 and the inside insertion plug 34 are inserted into the inside cylinder portion 31B and optically connected to each other. The inside of the inside cylinder portion 31B includes an outsider insertion plug holder portion 31C and an inside insertion plug holder portion 31D. A later-mentioned cylinder portion 41 of the outside insertion plug 33 is inserted into the outside insertion plug holder portion 31C in an airproofed state. A sealing material 39 for keeping airtight is provided between the outside insertion plug holder portion 31 and the cylinder portion 41 of the outside insertion plug 33.

A later-mentioned cylinder portion 43 of the inside insertion plug 34 is inserted into the inside insertion plug holder portion 31D. A gap ranging from 0.1 to 0.5 mm is provided between the inside insertion plug holder portion 31D and a cylinder portion 35 of the inside insertion plug 34 so that the cylinder portion 35 of the inside insertion plug 34 can be rotated and moved in an axial direction without coming into contact with the inside insertion plug holder portion 31D. An external thread is formed in an outer peripheral surface of the inside cylinder portion 31B so that the inside cover portion 32 is threaded.

The inside cover portion 32 supports the base end portion (upper end portion) of the fiber-in-hole portion 26 so that the base end portion of the fiber-in-hole portion 26 can be rotated and slightly moved in a vertical direction. The inside cover portion 32 includes a cap nut which has an opening 32A at its bottom portion. The inner diameter of the inside cover portion 32 is set slightly larger than the outer diameter of a later-mentioned flange portion 44 of the inside insertion plug 34 so that the inside insertion plug 34 can be freely rotated and freely moved in the axial direction. The inner diameter of the opening 32A is set slightly larger than the outer diameter of a later-mentioned cylinder portion 43 of the inside insertion plug 34 so that the inside insertion plug 34 can be freely rotated and freely moved in the axial direction. Therefore, clearance is provided in the fiber-in-hole portion 26. This is because, when the fiber-in-hole portion 26 is influence by some sort of external force, the external force is absorbed so that the fiber-in-hole portion 26 is not damaged.

An internal thread is formed in the inside surface of the inside cover portion 32 and threaded into the external thread of the inside cylinder portion 31B of the outside cover portion 31. At this point, in the interval between the inside cylinder portion 31B and the bottom portion of the inside cover portion 32, the thread is set so that the gap ranging from 0.1 to 0.5 mm is formed when the flange portion 44 of the inside insertion plug 34 is inserted into the interval between the inside cylinder portion 31B and the bottom portion of the inside cover portion 32. Accordingly, the inside insertion plug 34 (fiber-in-hole portion 26) can be moved in the axial direction with the interval ranging from about 0.1 to about 0.5 mm.

The inside insertion plug 34 is inserted into the inside cover portion 32, and the inside cover portion 32 is threaded in the inside cylinder portion 31B of the outside cover portion 31. Accordingly, an optical axis of the inside insertion plug 34 corresponds to the optical axis of the outside insertion plug 33.

The outside insertion plug 33 is the member for attaching the front end portion of the external fiber portion 27 to the outside insertion plug holder portion 31C of the outside cover portion 31. The outside insertion plug 33 includes a cylinder portion 41 and a flange portion 42.

The cylinder portion 41 is inserted into the outside insertion plug holder portion 31C of the outside cover portion 31. The cylinder portion 41 is mounted while holding the front end portion of the external fiber portion 27. Accordingly, the optical axis of the external fiber portion 27 is adjusted to a set position to connect to the fiber-in-hole portion 26 by inserting the cylinder portion 41 into the outside insertion plug holder portion 31C of the outside cover portion 31.

The flange portion 42 supports the cylinder portion 41 at a set depth while the cylinder portion 41 is inserted into the outside insertion plug holder portion 31C of the outside cover portion 31. The flange portion 42 is provided in the outer periphery of the cylinder portion 41, and the flange portion 42 is configured to support the cylinder portion 41 at the set depth by abutting on the outside cover portion 31 at the position where the cylinder portion 41 is inserted to the same depth as the outside insertion plug holder portion 31C.

The inside insertion plug 34 is the member for attaching the base end portion of the fiber-in-hole portion 26 to the inside insertion plug holder portion 31D of the outside cover portion 31. The inside insertion plug 34 includes the cylinder portion 43 and the flange portion 44.

The cylinder portion 43 is inserted into the inside insertion plug holder portion 31D of the outside cover portion 31 and the opening 32A of the inside cover portion 32. The cylinder portion 43 is mounted while holding the base end portion of the fiber-in-hole portion 26. Accordingly, the optical axis of the fiber-in-hole portion 26 is adjusted to the set position to connect to the external fiber portion 27 by attaching the cylinder portion 43 between the inside cover portion 32 and the inside cylinder portion 31B of the outside cover portion 31.

The flange portion 44 supports the cylinder portion 43. The flange portion is provided in the outer periphery of the cylinder portion 43. The outer diameter of the flange portion 44 is set slightly smaller than the inner diameter of the opening 32A of the inside cover portion 32 so that the inside insertion plug 34 can be freely moved in the rotational direction and the vertical direction within the inside cover portion 32. Therefore, similarly to the external fiber portion 27, the fiber-in-hole portion 26 is usually supported without rotation. Even if the fiber-in-hole portion 26 comes into contact with the inside wall surfaces of the suction cylinder 12 and the optical fiber holder member 17 which are rotated during the polishing operation and the force is applied in the rotational direction or the vertical direction, the force is eliminated by the inside insertion plug 34 which can be freely rotated and moved, and the damage to the fiber-in-hole portion 26 is prevented.

In the case where the optical fiber 15 is attached to the suction hole 11, the fiber-in-hole portion 26 of the optical fiber 15 is passes through the suction hole to attach the optical fiber rotary joint 28 to the upper end portion of the suction cylinder 12. The front end of the fiber-in-hole portion 26 is inserted into the support hole 20 of the optical fiber holder member 17 at the front end portion of the suction hole 11. At this point, the front end of the fiber-in-hole portion 26 is guided along the inclined-surface of the guide portion 23 to the upper-side small hole portion 22A and guided to the taper 22C to be inserted into and supported by the lower-side small hole portion 22B. In the case where the holder unit 2 is changed to another holder unit 2 having a different size corresponding to the diameter of the wafer 7, the holder unit 2 is unloosened downward from a rotation support unit 9. Therefore, the front end of the fiber-in-hole portion 26 is taken out from the small hole portion 22 of the optical fiber holder member 17. When the holder unit 2 having the different size is attached to the rotation support unit 9 from the lower side, the front end of the fiber-in-hole portion 26 which droops downward is guided by the guide portion 23 of the optical fiber holder member 17 and inserted into the lower-side small hole portion 22B from the upper-side small hole portion 22A through the taper 22C. Therefore, the fiber-in-hole portion 26 can be accurately and easily inserted into and pulled out. Namely, replacement operation of the holder unit 2 becomes easy, and the holder unit 2 can be easily replaced to the size of the wafer 7.

As shown in FIGS. 1 and 2, the polishing surface plate 4 includes a table 46 and a rotational axis 47. A polishing cloth is glued on the upper surface of the table 46 to polish the surface of the wafer 7. The rotational axis 47 rotates the table 46 at a set rotational speed. A driving device (not shown) for rotating the table 46 at set speed is provided in the rotational axis 47.

The control unit 5 includes the infrared white light source 51, the spectroscope 52, and a personal computer 53.

Figure 11:
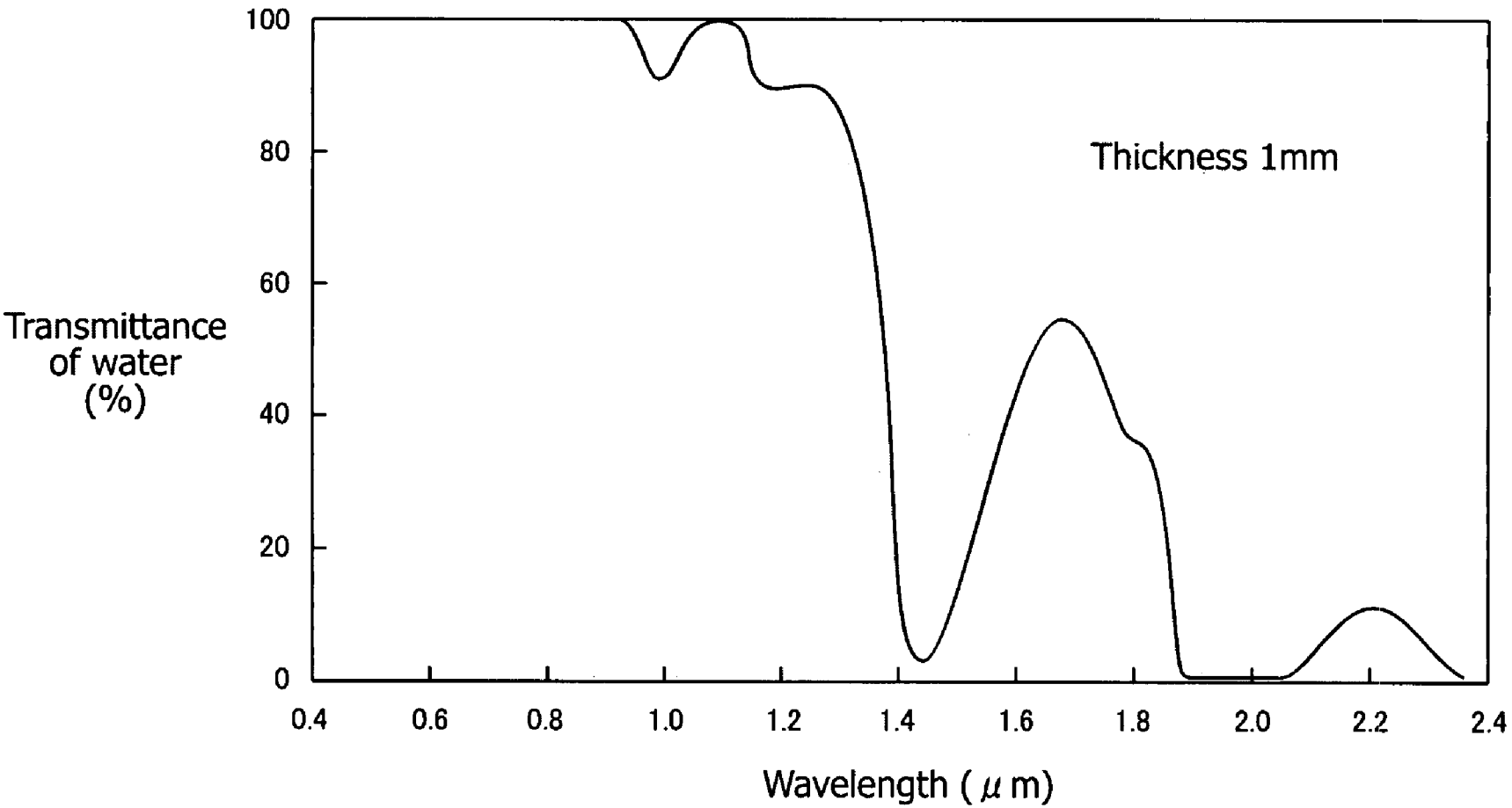
FIG. 11 is a graph showing transmittance of water.

The infrared white light source 51 generates the probe light. In the case where visible light is used as a wavelength of the probe light, since the light is not transmitted when the thickness of the Si layer is increased, it is difficult to perform the measurement from the backside of the SOI wafer in the substrate holder portion. Obviously it is difficult to measure the total thickness of the wafer having the thickness larger than that of the SOI wafer. Therefore, in consideration of a transmission band of water (1.0 μm to 1.4 μm, 1.5 μm to 1.9 μm, and 2.1 μm to 2.4 μm, see FIG. 11) used for the polishing the transmission band of Si (not lower than 1 μm), and the transmission band of the Ge-doped silica optical fiber (0.4 μm to 2.1 μm), it μs preferable that the wavelength of the probe light ranges from 1 to 2.4 μm. Accordingly, while the influence of water id suppressed, the optical fiber having the excellent handling characteristics can be applied, and the measurement from the backside of the wafer becomes possible.

A commercially available halogen light source is used as the infrared white light source 51, an inside infrared cut filter is removed so that the infrared light can be output, and a reflecting plate of a lamp is changed to the gold-plated reflecting plate which has uniform reflection characteristics in the infrared region.

The spectroscope 52 measures the interference of the reflected light from the wafer 7.

The are two methods of measuring the thickness of the Si layer, namely the method which measures a spectrum with a dispersion type spectroscope including a photo diode array sensing the light in the visible region, and the method which samples the infrared spectrum with a Fourier transform infrared spectroscopy (FTIR).

Figure 12:
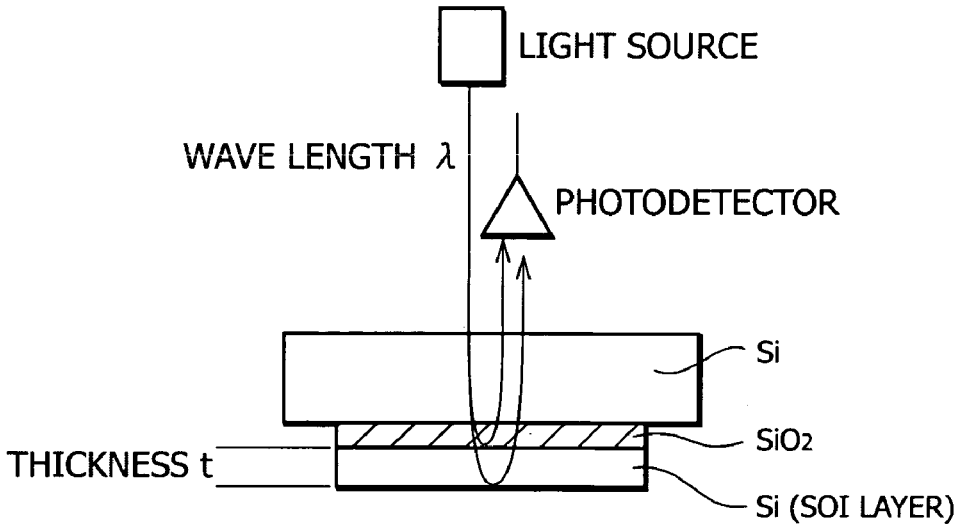
FIG. 12 is a schematic block diagram showing an example of measurement of an SOI layer.

The principle of these methods is one which measures the thickness with the spectroscope according to a light interference method. For example, for the SOI wafer, when the light is incident from the backside of the wafer to measure the reflected light intensity in the arrangement shown in FIG. 12, the transmission intensity becomes the maximum by the interference in the case where the following equations are satisfied.

$$2tn=m\cdot\lambda_m(m\text{: integer}) \quad (1)$$

$$2tn=(m+1)\cdot\lambda_{m+1} \quad (2)$$

n: reflective index of Si (=3.45)

The following equation (3) is obtained from the equations (1) and (2).

$$\begin{aligned} t &= 1/(2n)\times[(1/\lambda_{m+1})-(1/\lambda_m)]^{-1} \quad (3)\\ &= 1/(2n)\times(k_{m+1}-k_m)^{-1}\\ &= 1/(2n\Delta k) \end{aligned}$$

t: thickness n: reflective index of Si

λ: wavelength of probe light m: integer

When the spectral characteristics are checked in the above-described way, the maximum value of the transmission intensity can be observed in each Δk which is inversely proportional to the thickness t. The interference intensity depends on the thickness of the subject to be measured, so that the thickness can be also determined from the interference intensity.

In the measurement during the polishing process, the fluctuation in light quantity may be generated by various conditions such as wax unevenness on the backside of the wafer 7, soil of the front end surface of the fiber-in-hole portion 26, water on the wafer 7, and slight offset caused by the rotation. Because a wave number interval is principally constant independently of the transmission intensity of the optical system, the measurement of the wave number interval is optimum for the measurement in which the transmittance is fluctuated.

Figure 13:
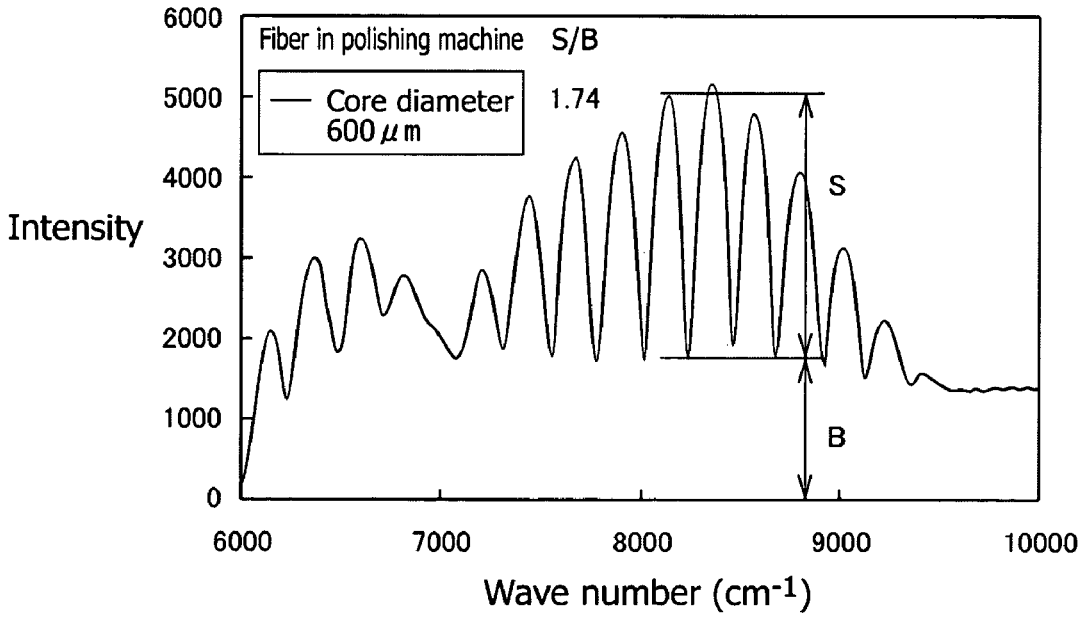
FIG. 13 is a graph showing a relationship between intensity and a wave number of reflected light.

FIG. 13 shows an example of measurement with FTIR. In the case of the use of FTIR, since a mirror of a Michelson interferometer is mechanically scanned inside FTIR, it takes a long time to perform the measurement, and the stable spectrum can not be sampled. Further, in order that the optical fiber can be applied and the transmission band of water (not more than 1.4 μm, or 1.5 μm to 1.9 μm) can be measured, it is necessary to use an expensive InSb detector in which cooling is required at a liquid nitrogen temperature. FTIR is an extremely large-scale apparatus, the optical system is sensitive to vibration, much installation space is required, and sometimes it is difficult to install in the polishing process in which much vibration occurs.

Figure 14:
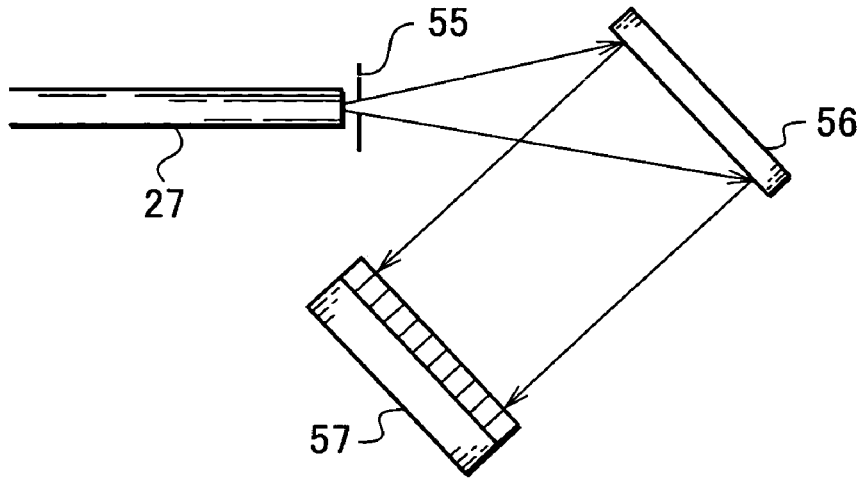
FIG. 14 is a schematic block diagram showing an example of a configuration of a spectroscope.

On the contrary, unlike FTIR, the dispersion type multi-channel spectroscope using the photodiodes is usually small (less than tens of cubic centimeters), and the dispersion type multi-channel spectroscope can obtains the spectrum sufficient to perform the measurement, even if exposure time is tens of milliseconds, depending on the optical system. Therefore, even if the light intensity is changed (fluctuation in transmittance caused by the offset of the optical fiber) in guiding the light from the rotating wafer, the measurement can be performed without affecting the influence of the change in light intensity. This means that the measuring time is shortened at one point and the high-response-speed, real-time thickness output becomes possible. Accordingly, the dispersion type multi-channel spectroscope using the photodiodes is used as the spectroscope 52. FIG. 14 shows the schematic block diagram of the spectroscope 52. The spectroscope 52 mainly includes a slit 55, a diffraction grating 56, and a photodiode array 57. The slit 55 focuses the reflected light propagating through the external fiber portion 27 to a width of the diffraction grating 56. The diffraction grating 56 diffracts the reflected light and causes the reflected light to be incident to the photodiode array 57. The photodiode array 57 converts the incident light into voltage corresponding to the intensity of the interference to output the voltage to the personal computer 53.

A 512-channel InGaAs array is used as the photodiode array 57 of the spectroscope 52. The 512-channel InGaAs array can perform the measurement in the measurement wavelength region ranging from 0.85 μm to 1.75 μm with element resolution of 0.00175 μm (1.75 nm). When the wavelength of the resolution is converted to the wave number, the measurement can be performed with the resolution not lower than about 10 $cm^{-1}$. The wave number of about 10 $cm^{-1}$ corresponds to about a hundred and tens of micrometers in the Si thickness, and it is estimated from a sampling theorem that the thickness measurement can be performed up to about 50 μm. The measurement is performed on the condition that the slit 55 is set to 25 μm and the exposure time is set to 50 msec.

The infrared detection type photodiode array in which an infrared photo-induced fluorescent material (material converting the infrared light to the visible light) is applied on the Si photodiode array can be also used as the photodiode array having the sensitivity in near infrared light. In this case, although the measurement wavelength is limited to the infrared light detection sensitivity of the infrared photo-induced fluorescent material (the material usually having the sensitivity ranging from 1.45 μm to 1.65 μm is commercially available), since the Si photodiode array in which high-density array technology has been realized is used, the high resolution can be realized and the thickness measurement of the Si wafer itself in which Δk is decreased can be also used.

The personal computer 53 calculates a polishing target thickness from the thicknesses at a plurality of points of the wafer 7 before the surface polishing, while calculating the thickness of the wafer 7 on the basis of the signal from the photodiode array 57. The personal computer 53 controls the overall surface polishing apparatus 1.

The thickness of the wafer 7 is calculated on the basis of the above equation (3).

The polishing target thickness is calculated from the following equation.

The thicknesses at the plurality of points in the surface of the wafer 7 are measured in addition to the measurement of the central thickness of the wafer 7 before the surface polishing, and the polishing target thickness is determined by the following equation.

$$t_{cfin}=t_{aim}+t_c-(t_{max}+t_{min})/2 \quad (4)$$

$t_{cfin}$: polishing target thickness $t_{aim}$: required film thickness $t_c$: central thickness of thin film-like material $t_{max}$: maximum thickness in in-plane measurement points $t_{min}$: minimum thickness in in-plane measurement points Otherwise, the polishing target thickness is determined by the following equation.

$$t_{cfin}=t_{aim}+t_c-t_{ave} \quad (5)$$

$t_{cfin}$: polishing target thickness $t_{aim}$: required film thickness $t_c$: central thickness of thin film-like material $t_{ave}$: average thickness in in-plane measurement points A polishing finish point is determined from the equations (4) and (5) so that deviation from the required film thickness is decreased.

In the personal computer 53, the spectrum is sampled from the spectroscope 52 every 0.5 second to calculate the film thickness by a peak-to valley method or a maximum entropy method.

In the spectroscopy using the photodiode array, there is the limitation to the number of channels of the used array spectroscope, and there is also the limitation to the resolution, so that the calculation can not be performed when the thickness is increased and the maximum value and the minimum value are not directly read. Therefore, it is preferable to apply the maximum entropy method in which the resolution can be arbitrarily increased even if the number of data points is small. This allows the resolution of the thickness measurement to be increased.

[Method of Measuring Thickness of Thin Film-Like Material during Surface Polishing and Surface Polishing Method]

Then, the method of measuring the thickness of the thin film-like material during the surface polishing and the surface polishing method, which use the surface polishing apparatus 1 having the above-described configuration, will be described referring to the accompanying drawings. In the following example, the surface polishing apparatus 1 is used when the thickness of the SOI layer is measured during the polishing of the SOI wafer.

Figure 15:
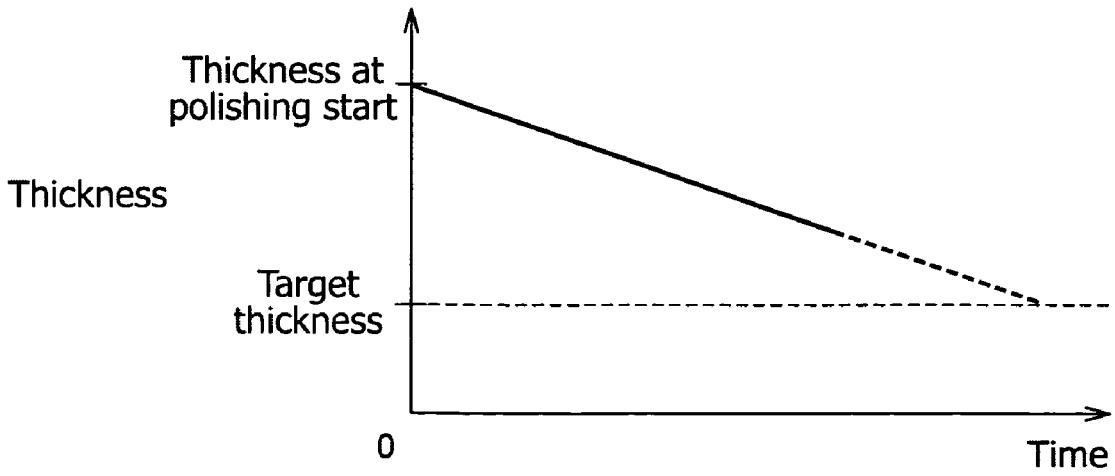
FIG. 15 is a graph showing the relationship a fluctuation in thickness of a thin film-like material and working time during surface polishing operation.

The polishing target thickness is determined first. Before the polishing, the thicknesses are measured at the plurality of points of the wafer 7 to be polished. The polishing target film thickness is calculated by the equations (4) and (5) on the basis of the measurement values. As shown in a table of FIG. 15, on the basis of the calculated polishing target film thickness, the thickness of the wafer 7 is caused to be close to the polishing target film thickness while measuring the thickness of the wafer 7 during the surface polishing.

In the case where the surface polishing operation is performed, the holder unit 2 and the polishing surface plate 4 of the surface polishing apparatus 1 are rotated at the set number of revolutions to start the surface polishing of the wafer 7 with the polishing cloth of the table 46 of the polishing surface plate 4.

Then, the infrared white light (probe light) is generated from the infrared white light source 51 of the control unit 5, and the backside of the wafer 7 is irradiated with the probe light. Specifically, the probe light source from the infrared white light source 51 is caused to be incident to the fiber-in-hole portion 26 through the external fiber portion 27 and the optical fiber rotary joint 28, and the backside of the wafer 7 during the surface polishing, which is rotated through the gap of about 0.1 mm from the front end surface of the fiber-in-hole portion 26, is irradiated with the probe light.

The light with which the SOI layer of the wafer 7 is irradiated generates the interference to create the reflected light which has the maximum and the minimum in each wavelength. The reflected light penetrates inside the fiber-in-hole portion 26 from the front end surface of the fiber-in-hole portion 26, and part of the reflected light is transmitted to the spectroscope 52 of the control unit 5 through the external fiber portion 27.

The reflected light transmitted to the spectroscope 52 is spatially dispersed in each wavelength with the diffraction grating 56 in the spectroscope 52, and the photodiode array 57 is irradiated with the reflected light. Then, the light intensity in each channel is converted into the electric signal by the photodiode array 57. The interference spectrum of the surface of the SOI wafer 7 is measured in the above-described way.

In the measured spectrum, the wave number interval Δk is measured by the personal computer 53, and the conversion into the thickness is performed from the equation (3) using the refractive index n.

Figure 16:
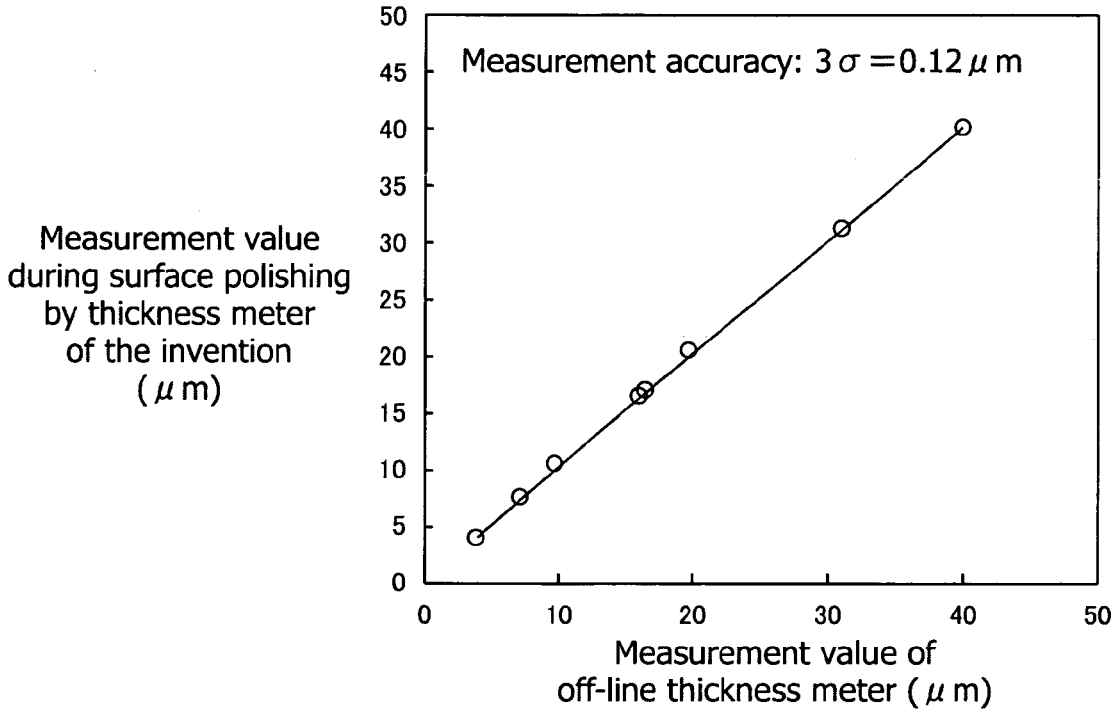
FIG. 16 is a graph comparing an off-line measurement value of the thickness and the measurement value of the thickness during the surface polishing.

FIG. 16 shows the fluctuation in thickness measurement value of the wafer 7 during the surface polishing. Although the light quantity is slightly changed, the constant film thickness is output independently of the rotation.

Figure 17:
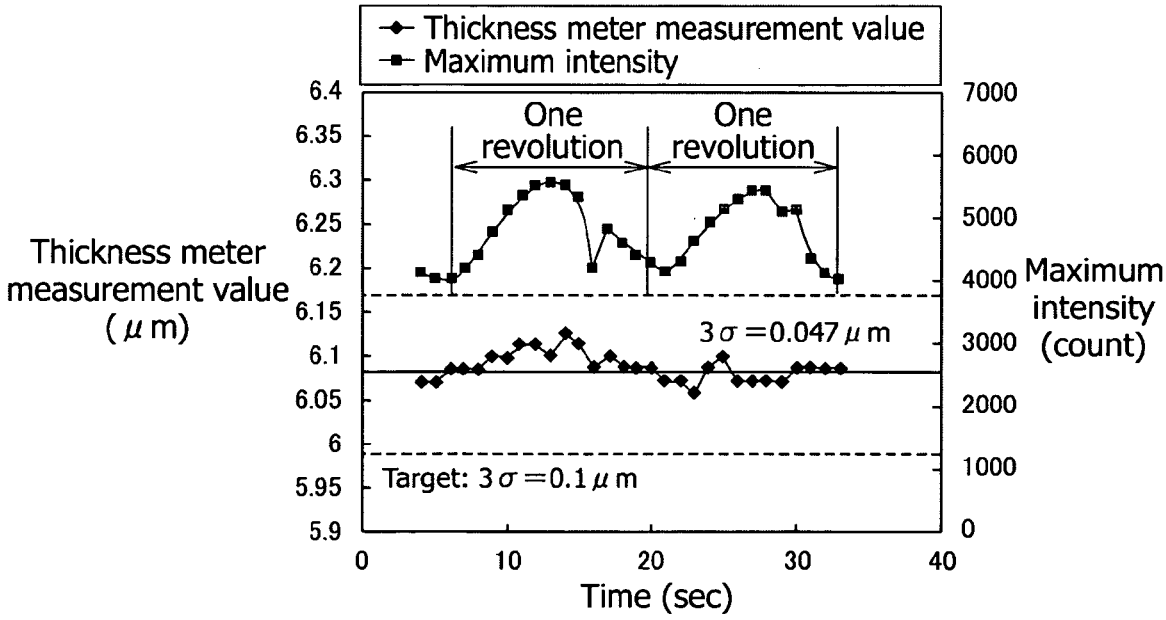
FIG. 17 is a graph showing the relationship among the measurement value of a film thickness, a maximum intensity, and time.

FIG. 17 shows the result in which measurement accuracy of the thickness measuring method of the invention is verified. The finish point thickness measured with a thickness meter of the invention was compared to the finish point thickness measured with an off-line thickness meter using FTIR after the surface polishing. In the actual measurement, the thickness could be stably performed up to about 40 μm, and the measurement could be performed with accuracy 3 σ=0.12 μm sufficient for the operation within the range of the sampling theorem.

Therefore, while the thickness of the wafer 7 is accurately measured during the surface polishing, the wafer 7 can be accurately polished to the target thickness, without influenced by the holder unit 2.

As described in detail above, according to the method of measuring the thickness of the thin film-like material during the surface polishing, the surface polishing method, and the surface polishing apparatus, the following effects can be achieved.

(1) The light having the wavelength ranging from 1 to 2.4 μm is used as the measuring wavelength. Therefore, the probe light which has the excellent transmission to water used in the polishing, the excellent transmission to Si, and the excellent transmission to the optical fiber can be obtained. The thin film-like material is irradiated from the backside to measure the spectrum of the reflected light with the dispersion type multi-channel spectroscope. Therefore, the thickness of the thin film-like material can be stably and accurately detected during the polishing operation.

(2) Since the InGaAs array is used as the photodiode array, the reflected light having the wavelength ranging from 1 to 2.4 μm can be detected with high sensitivity and the thickness of the thin film-like material can be accurately detected during the surface polishing.

Recently, the InGaAs photodiode which has the sensitivity around the range of 1 to 2.5 μm can be formed in the array having the channels more than 512 by the progress of the device technology, so that cost reduction of the surface polishing apparatus 1 can be achieved.

(3) Since the fluorescent coating which emits the visible light when the light having the wavelength ranging from 1 to 2.4 μm is incident is applied onto the surface of the photodiode array, the reflected light reflected by irradiating the thin film-like material with the probe light having the wavelength ranging from 1 to 2.4 μm can be converted into the visible light by the fluorescent coating and securely detected with the photodiode array.

(4) The thickness of the thin film-like material can be accurately detected by measuring the period of the interference waveform (wave number interval) Δk to calculate the thickness of the thin film-like material from the equation of $t=1/(2n\Delta k)$ during the surface polishing.

(5) The thickness of the thin film-like material which has the thickness not lower than 4 μm, particularly not lower than 5 μm can be accurately measured by measuring the period of the interference waveform μk from frequency estimation by an autoregressive model.

(6) The surface polishing is performed while the thickness of the thin film-like material is measured by the above-described thickness measuring method, and the polishing is finished when the thickness reaches the target thickness. Therefore, during the surface polishing of the thin film-like material such as the wafer, the thickness of the thin film-like material can be measured without stopping the polishing operation, and the polishing can be accurately performed on the basis of the measurement result. As a result, quality and yield percentage of the thin film-like material can be remarkably improved.

(7) Before the polishing, the thicknesses of the plurality of points in the surface of the thin film-like material are measured in addition to the central thickness of the thin film-like material, and the polishing target thickness is determined from the equation of $t_{cfin}=t_{aim}+t_c-(t_{max}+t_{min})/2$. Therefore, the surface polishing of the thin film-like material can be accurately performed to the polishing target film thickness.

(8) Before the polishing, the thicknesses of the plurality of points in the surface of the thin film-like material are measured in addition to the central thickness of the thin film-like material, and the polishing target thickness is determined from the equation of $t_{cfin}=t_{aim}+t_c-t_{ave}$. Therefore, the surface polishing of the thin film-like material can be accurately performed to the polishing target film thickness.

(9) The optical fiber holder member includes the support hole which positions the front end of the optical fiber to rotatably and detachably support the optical fiber, and the support hole includes the small hole portion which has the inner diameter slightly larger than the diameter of the optical fiber and the taper-shaped guide portion which is continuously formed from the small hole portion and guides the front end of the optical fiber along the inclined surface to the small hole portion. Therefore, while the optical fiber can be easily inserted and pulled out, the damage of the optical fiber can be prevented.

(10) While the optical fiber is continuously provided from the front end portion of the communication hole to the external instrument through the base end opening, the front end surface of the optical fiber is provided to face the backside of the thin film-like material in the surface polishing, so that the irradiation of the probe light can be accurately performed and the reflected light can be securely detected.

(11) The optical fiber includes the fiber-in-hole portion which is passed through the communication hole and the external fiber portion which is drawn outside to connect to the external instrument, the fiber-in-hole portion is rotatably supported in the communication hole, and the external fiber portion is connected to the fiber-in-hole portion by the optical fiber rotary joint while the rotation is absorbed. Therefore, while the thickness of the thin film-like material can be accurately measured during the surface polishing without affecting the influence of the holder unit which holds and rotates the thin film-like material, the thin film-like material can be accurately polished to the target thickness.

(12) The single core optical fiber is used as the fiber-in-hole portion, and the bundle type fiber in which a part of the plurality of optical fibers is connected to the spectroscope and the remaining optical fibers are connected to the infrared white light source is used as the external fiber portion, and the effective core diameter of the bundle type fiber is made smaller than the core diameter of the single core optical fiber. Therefore, the backside of the thin film-like material can be securely irradiated with the probe light to securely detect the reflected light.

Although the optical fiber 15 was divided into the fiber-in-hole portion 26 and the external fiber portion 27 to connect to the optical fiber rotary joint 28 in the above embodiments, it is also possible that the optical fiber holder member 17 is connected to the infrared white light source 51 and the spectroscope 52 in the control unit 5 by the continuous optical fiber 15, in which the fiber-in-hole portion 26 and the external fiber portion 27 are not divided and the optical fiber rotary joint 28 is not provided. In this case, it is possible that the infrared white light source 51 and the spectroscope 52 are connected to the optical fiber 15 by a half mirror respectively. It is also possible that each one optical fiber 15 is connected to the infrared white light source 51 and the spectroscope 52 and each optical fiber 15 faces the backside of the wafer from the optical fiber holder member 17. In this case, each optical fiber 15 is arranged at the backside of the wafer 7 while symmetrically having the same angle relative to a perpendicular to the wafer 7. Therefore, when the backside of the wafer 7 is irradiated with the probe light from the front end surface of the optical fiber 15 connected to the infrared white light source 51, the reflected light is incident to the front end surface of the optical fiber 15 connected to the spectroscope 52 and transmitted to the spectroscope 52.

In this case, the wafer 7 can be also accurately polished to the target thickness, while the thickness of the wafer 7 is accurately measured during the surface polishing.

What is claimed is:

1. A method of measuring thickness of a thin film material during surface polishing of one surface of the thin film material, the method comprising the steps of:

irradiating a second surface of the thin film material, opposite the one surface, during the surface polishing with probe light having a wavelength ranging from 1 to 2.4 μm, to produce a reflectance spectrum;

measuring the reflectance spectrum with a dispersion type multi-channel spectroscope using a photodiode array which has sensitivity to the probe light;

calculating the thickness on the basis of a waveform of the reflectance spectrum; and controlling the surface polishing, in accordance with the calculated thickness, to provide the thin film material with a target thickness;

wherein the photodiode array has a fluorescent coating, said fluorescent coating emitting visible light responsive to the probe light incident thereon.

2. A method of measuring thickness of the thin film material during surface polishing of one surface of the thin film material, wherein a second surface of the thin film material, opposite the one surface, is irradiated during the surface polishing with probe light having a wavelength ranging from 1 to 2.4 μm to produce a reflectance spectrum;

wherein the reflectance spectrum is measured with a dispersion type multi-channel spectroscope using a photodiode array which has sensitivity to the probe light;

wherein the thickness is calculated on the basis of a waveform of the reflectance spectrum, wherein the polishing is discontinued when the calculated thickness of thin film material reaches a target thickness; and wherein, before the polishing, the thicknesses of a plurality of points in the surface of the thin film material are measured in addition to a central thickness of the thin film material, and the target thickness is determined from the following equation:

$$t_{cfin}=t_{aim}+t_c-(t_{max}+t_{min})/2$$

$t_{cfin}$: target thickness $t_{aim}$: required film thickness $t_c$: central thickness of thin film material $t_{max}$: maximum thickness in in-plane measurement points $t_{min}$: minimum thickness in in-plane measurement points.

3. A method of measuring thickness of the thin film material during surface polishing of one surface of the thin film material, wherein a second surface of the thin film material, opposite the one surface, is irradiated during the surface polishing with probe light having a wavelength ranging from 1 to 2.4 μm to produce a reflectance spectrum;

wherein the reflectance spectrum is measured with a dispersion type multi-channel spectroscope using a photodiode array which has sensitivity to the probe light;

wherein the thickness is calculated on the basis of a waveform of the reflectance spectrum, wherein the polishing is discontinued when the calculated thickness of thin film material reaches a target thickness; and wherein, before the polishing, the thicknesses of the plurality of points in the surface of the thin film material are measured in addition to the central thickness of the thin film material, and the target thickness is determined from the following equation:

$$t_{cfin}=t_{aim}+t_c-t_{ave}$$

$t_{cfin}$: target thickness $t_{aim}$: required film thickness $t_c$: central thickness of the thin film material $t_{ave}$: average thickness in in-plane measurement points.

4. A surface polishing apparatus including a holder unit holding a thin film material to be polished on one surface and a main body unit rotatably supporting the holder unit and rotatably driving the holder unit, the surface polishing apparatus comprising:

a communication hole which extends through the main body unit along a central axis of rotation of the holder unit;

an optical fiber which extends through the communication hole, a front end of the optical fiber having a front end surface facing a second surface of the thin film material, opposite the first surface, during the surface polishing, the thin film material during the surface polishing being irradiated with probe light for thickness measurement, the probe light reflected from the thin film material being incident on the optical fiber; and an optical fiber holder member, provided at the front end of the optical fiber, to support the front end of the optical fiber within the holder unit, the optical fiber holder member including a support hole which positions the front end of the optical fiber to rotatably and detachably support the front end of the optical fiber, and the support hole including a small hole portion having an inner diameter slightly larger than a diameter of the optical fiber and a taper-shaped guide portion, which is continuous with the small hole portion, for guiding the front end of the optical fiber along an inclined surface into the small hole portion.

5. The surface polishing apparatus according to claim 4, wherein the front end surface of the optical fiber is provided to face the backside of the thin film material during the surface polishing, while the optical fiber extends from the communication hole to an external instrument through a base end opening.

6. The surface polishing apparatus according to claim 4, wherein the optical fiber includes a fiber-in-hole portion which is passed through the communication hole and an external fiber portion which is drawn outside to connect to the external instrument, the fiber-in-hole portion is rotatably supported in the communication hole, and the external fiber portion is connected to the fiber-in-hole portion by an optical fiber rotary joint.

7. The surface polishing apparatus according to claim 6, wherein a single core optical fiber is used as the fiber-in-hole portion, and a bundle type fiber in which some of the plurality of optical fibers are connected to the spectroscope and the remaining optical fibers are connected to an infrared white light source is used as the external fiber portion, and an effective core diameter of the bundle type fiber is smaller than the core diameter of the single core optical fiber.

* * * * *